US006361038B1

(12) United States Patent
Tada et al.

(10) Patent No.: US 6,361,038 B1
(45) Date of Patent: Mar. 26, 2002

(54) SHEET FEEDING APPARATUS, IMAGE FORMING APPARATUS AND SHEET FEEDING METHOD

(75) Inventors: Michio Tada; Daisuke Imada; Yasutaka Komatsu, all of Ebina (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 09/520,786

(22) Filed: Mar. 8, 2000

(30) Foreign Application Priority Data

May 20, 1999 (JP) ..... 11-140343

(51) Int. Cl.[7] ..... B65H 7/08
(52) U.S. Cl. ..... 271/111
(58) Field of Search ..... 271/110, 127, 271/259, 162, 152, 25, 31, 38, 111

(56) References Cited

U.S. PATENT DOCUMENTS 5,104,111 A * 4/1992 Matsuda et al. ..... 271/110
6,244,588 B1 * 1/2001 Tsubakimoto et al. ..... 271/110

FOREIGN PATENT DOCUMENTS

JP A-5-213483 8/1993
JP A-5-221553 8/1993
JP Y2-6-30753 8/1994
JP A-7-172624 7/1995

* cited by examiner

*Primary Examiner*—Christopher P. Ellis
*Assistant Examiner*—Kenneth W Bower
(74) *Attorney, Agent, or Firm*—Oliff & Berridge, PLC

(57) ABSTRACT

An image forming apparatus is capable of detecting the presence or absence of sheets before a bottom plate moves up during a so-called initial operation, such as an operation for setting a sheet loading tray in the apparatus, and preventing the bottom plate from running wildly during, for example, an upward movement thereof. The apparatus includes an image forming unit for forming an image on a sheet transferred thereto, a sheet loading tray having a bottom plate which is loaded with sheets to be transferred to the image forming unit, and which is adapted to be vertically moved, a sheet nudging member for feeding the sheets from an upper side of the sheets stacked on the bottom plate toward the image forming unit, a first sensor provided above the sheet loading tray and adapted to detect the presence or absence of the sheets, a second sensor provided on the bottom plate of the sheet loading tray and adapted to detect the presence or absence of the sheets, and a control unit for controlling the vertical movements of the bottom plate of the sheet loading tray. The control unit is adapted to prohibit an upward movement of the bottom plate when the sheets are not detected by the second sensor at the time of setting the sheet loading tray in the apparatus.

7 Claims, 5 Drawing Sheets

SHEET FEEDING APPARATUS, IMAGE FORMING APPARATUS AND SHEET FEEDING METHOD

BACKGROUND OF THE INVENTION

1. Field of the Invention

This invention relates to a sheet feeding apparatus adapted to send out sheets stacked in a sheet feeding tray, a sheet feeding method, and an image forming apparatus, such as a printer, a copier and a facsimile transfer unit which use the same method.

2. Description of the Related Art

In an image forming apparatus, such as a printer, a copier and a facsimile transfer unit, a sheet feeding apparatus is generally provided so as to output an image formed in an image forming section thereof using an electrophotographic system. In this sheet feeding apparatus, sheets (paper), materials on which information is to be recorded including paper and OHP sheets are stacked in a sheet feeding tray or a sheet feeding cassette, from which the sheets are fed one by one, and sent to the image forming section.

In recent years, the image processing techniques used in this image forming section have progressed, and the formation of a large quantity of images can be carried out practically in a short period of time. In the meantime, it has become necessary to stack sheets in large quantities in a paper feeding tray or a paper feeding cassette, and the increasing of a sheet loading capacity of a paper feeding tray and a paper feeding cassette has been increasingly demanded.

In such an image forming apparatus, a sheet feeding method including lifting sheets after they have been stacked in a paper feeding tray of an increased load capacity by a user (operator), to a position of a predetermined height, and feeding in the same position the sheets one by one from the upper side of the stacked sheets is generally used. To lift the sheets, an elevator tray system in which a sheet-loaded bottom plate is moved up as the bottom plate is kept horizontal, or a lever system in which one end portion of a bottom plate is raised around the other end portion thereof is employed. In these systems, it becomes necessary to set a position (height) of an upper side of stacked sheets to the height of a lower surface of a nudger roll which contacts the upper side of the sheets, and maintain a pressure of the nudger roll against the sheets at a substantially constant level. Namely, in these sheet feeding apparatuses, it becomes necessary that a mechanism for detecting the height of the upper side of the sheets be provided besides a mechanism for detecting the presence or absence of a sheet the provision of which constitutes a prerequisite for the sheet feeding apparatuses.

The sheet feeding apparatuses of the related art include sheet feeding apparatuses disclosed in, for example, Japanese Patent Laid-Open Nos. 213483/1993, 221553/1993 and 172624 and Japanese Utility Model Publication No. 30753/1994. Japanese Patent No. 213483/1993 mentioned above, in which a bottom plate is not lifted, discloses the techniques for detecting a residual quantity of sheets by turning a pickup roll in accordance with the lowering of a sheet takeoff position, and displaying the shortage of the sheets before the sheets have run out. Japanese Patent Laid-Open No. 221553/1993 discloses the techniques for detecting the presence or absence of sheets on the basis of the condition of displacement, which occurs when a pivotable cassette is once lifted by a lifting member, of a takeoff unit provided at an upper portion of the cassette. Japanese Utility Model Publication No. 30753/1994 discloses the techniques for using a single mechanism for detecting both the height of a sheet in the uppermost position of stacked sheets and the run-out of the sheets, and thereby simplifying the structure of the detecting mechanism. Japanese Patent Laid-Open No. 172624/1995 discloses the techniques for detecting the absence of sheets and the height of lifted sheets with reference to the position of a lever type arm provided at an upper portion of a paper feeding tray.

However, according to the techniques disclosed in Japanese Patent Laid-Open No. 213483/1993, it is possible to detect a residual quantity of sheets during the transfer of the sheets but difficult to apply the techniques to the detection of a residual quantity of sheets in a bottom plate lifting type sheet feeding apparatus, and, furthermore, impossible to detect the presence or absence of sheets during an initial operation carried out prior to the lifting of a bottom plate.

According to the techniques disclosed in Japanese Patent Laid-Open No. 221553/1993, the presence or absence of sheets can be detected by a bottom plate lifting mechanism during an initial operation and in the midst of the transfer of the sheets but this detecting operation cannot be carried out until a pivotably provided cassette has been lifted by a lifting member, so that it takes much time before the detection of the absence of the sheets is started. Especially, in the case of a sheet feeding apparatus loaded with a large quantity of sheets, it takes an extremely long period of time until an initial detection of the absence of sheets is carried out, and such a long period of wasteful time poses a problem which can constitute a defect of the commodity specifications.

The techniques disclosed in Japanese Utility Model Publication No. 30753/1994 enable a sheet detecting mechanism to be simplified, and are adapted to execute the detection of the height of sheets and the run-out thereof by a single sensor. Therefore, even in a so-called initial operation, in which, for example, a sheet which has got into a jam is removed with a cover then closed, it is necessary to lower a bottom plate by a predetermined height after it has once been lifted, so that the time carrying out the detection of the presence or absence of the sheets during an initial sheet feeding operation further increases. When a tray of a certain construction is used, it moves wildly while it is lifted during an initial operation, to cause the possibility of breakage of the apparatus to arise.

The techniques disclosed in Japanese Patent Laid-Open No. 172624/1995 are very advantageous in view of their capability of detecting the absence of sheets and the height thereof in a lifted state by a simple structure. However, according to these techniques, the absence of the sheets cannot be detected until a bottom plate has once been lifted. Therefore, just as in the techniques disclosed in each of the above-mentioned publications, a delay in the detection of the absence of sheets during an initial operation in, especially, a large capacity sheet feeding tray poses a problem, and, when a position in which the sheets are set is improper, there is the possibility that a sheet feeding mechanism be destroyed due to the lifting of the sheets.

SUMMARY OF THE INVENTION

The present invention has been made so as to solve these technical problems, and provides a sheet feeding apparatus and a sheet feeding method which are capable of detecting the presence or absence of sheets during a so-called initial operation in which a bottom plate has not yet moved up, and which enable a wild movement of a sheet feeding tray during, for example, an upward movement of the bottom plate to be prevented; and an image forming apparatus using the same apparatus and method.

As shown in FIG. 1, the sheet feeding apparatus according to the present invention is characterized by including a tray 1 loaded with sheets P, a sheet nudging member 2 adapted to send out a sheet P from an upper side of the sheets P stacked in the sheet loading tray 1, a first sensor 3 adapted to detect the sheet from an upper side of the sheets P stacked in the sheet loading tray 1, a second sensor 4 adapted to detect the sheets P from a lower side of the same P stacked in the sheet loading tray 1, and a control unit 5 adapted to detect the presence or absence of the sheets P on the basis of an output from the second sensor 4 during an initial operation, and the presence or absence of the sheet P on the basis of an output from the first sensor 3 during and after a sheet feeding operation.

A structural part on which the second sensor 4 is provided is not limited as long as the second sensor 4 is adapted to detect the sheets P from the lower side thereof. This sensor 4 is preferably capable of judging whether the sheets P loaded in a bundle are set correctly or not.

When the sheet loading tray 1 is formed so that it can be set during an initial operation by a user of the sheet feeding apparatus at the time of closing a power source switch of a sheet feeding apparatus body and also after the execution of a sheet stacking operation or an operation for removing a sheet which has got into a jam, for example, when the sheet loading tray 1 is formed so that it can be set in and removed from (withdrawable system) the apparatus body, the operational effect of the second sensor becomes high as long as an upward movement of a bottom plate 6, which will be described later, is made in accordance with the result of the detection of the presence or absence of the sheets P in a case where the sheet loading tray 1 is set after it has once been withdrawn.

This sensor is also effective while an operation for feeding the sheet P by the nudging member 2 is carried out during a sheet feeding operation, and also, while each sheet is fed during an operation for continuously feeding the multiple sheets P. When the feeding of the sheets is done by job, the detection operations of the second sensor carried out between sheets of a job, and also between adjacent jobs are effective.

When the sheet loading tray 1 is formed so as to be characterized by having a bottom plate lifting mechanism 7 adapted to move up after the sheets P have been stacked on the bottom plate 6, the presence or absence of the sheets can be detected by the second sensor 4 before the lifting of the bottom plate 6 by the bottom plate lifting mechanism 7 has been done, so that the lifting of the bottom plate 6 with the sheets not existing thereon can be prevented. Moreover, when a detection operation by the second sensor 4 is not carried out, though the sheets P exist on the bottom plate, the lifting of the bottom plate can be stopped, and this enables a trouble due to a user's error in the setting of the sheets P to be prevented.

When the second sensor 4 is characterized by being provided on the downstream side with respect to the sheet feeding direction of a position in the vicinity of the sheet nudging member 2, the sensor is preferable in that the sheets P can be lifted on the basis of the result of the detection of the sheets by the same sensor 4 provided on the downstream side of a position in the vicinity of the sheet nudging member 2. Especially, in a case where a system for stopping an upward movement of the bottom plate 6 when the uppermost sheet 2 contacts the sheet nudging member 2 is employed, the wild running of the bottom plate 6 can be prevented even when the user erroneously sets a bundle of sheets P, for example, in an upstream side position with respect to the sheet feeding direction. This can prevent the breakage of peripheral devices of the sheet nudging member 2. Also, it becomes possible to retain the performance of the sheet nudging member 2 of transferring the sheets P. Above all, in an apparatus not provided with an end guide for restricting the position of the sheets on the upstream side with respect to the sheet feeding direction, the condition in which the sheets are not set properly is liable to occur, and the structure according to the invention is specially effective in such an apparatus.

The image forming apparatus according to the present invention is characterized by including an image forming unit adapted to form an image on a sheet P transferred thereto, a sheet loading tray 1 provided therein with a bottom plate 6 which support thereon sheets P to be transferred to the image forming unit, and which is adapted to be vertically moved, a sheet nudging member 2 adapted to feed a sheet P from an upper side of the sheets P stacked on the bottom plate 1 toward the image forming unit, a first sensor 3 provided above the sheet loading tray land adapted to detect the presence or absence of the sheets P, a second sensor 4 provided on the bottom plate 6 in the sheet loading tray 1 and adapted to detect the presence and absence of the sheets P, and a control unit 5 adapted to control a vertical movement of the bottom plate 6 in the sheet loading tray 1, the control unit 5 being adapted to prohibit the bottom plate 6 from moving up when the sheets P are not detected by the second sensor 4 at the time of setting the sheet loading tray 1 on the apparatus.

To make a vertical movement of the bottom plate 6, using an elevator tray system, which is generally applied to a large-capacity tray, for lifting a bottom plate horizontally as well as a system for lifting one end portion of a bottom plate around the other end portion thereof as a fulcrum is conceivable. Although such systems to be employed do not matter, using, especially, the structure according to the present invention enables the time required until the detection of the presence or absence of sheets is started to be reduced, and a great effect to be obtained in an apparatus having a sheet feeding tray on which a large quantity of sheets are stacked, and in which the travel of the bottom plate is large.

Since an upward movement of the bottom plate 6 is prohibited in the mentioned case, the problem of occurrence of an upward movement of the bottom plate 6 which is based on an erroneous recognition given at the sheet loading time, and which leads to the destruction of structures in a sheet feeding section can be solved. From a viewpoint of solving this problem, the second sensor 4 is preferably disposed in a position corresponding to that in which there is a fear of occurrence of the destruction ascribed to an upward movement of the bottom plate of various kinds of structures.

In addition to the provision of such a function of prohibiting an upward movement of the bottom plate 6, providing a function of displaying the absence of sheets on, for example, a control panel of the apparatus, or on a host unit, such as a personal computer when the apparatus is connected thereto via an internet or a line can promote an early response of a user.

When the control unit 5 is formed so that it prohibits an upward movement of the bottom plate 6 during a sheet feeding operation in a case where a sheet P is not detected by the first sensor 3 during the same operation, the sheet P can be detected independently of an operation of the second sensor 4, whereby the detection of the sheet P can be conducted speedily and accurately. Applying such a control unit to, especially, an apparatus loaded with a large quantity of sheets and adapted to feed the sheets by finely lifting a sheet loading tray correspondingly to the lowering of the uppermost sheet surface which is based on the feeding of the sheets is preferable since the absence of sheets can be detected by a simple structure.

The sheet feeding method according to the present invention includes lifting a bottom plate 6 in accordance with the result of detection carried out by a first sensor 3 provided above a sheet loading tray 1 in which sheets P are stacked on the bottom plate 6, and a second sensor 4 provided in a lower portion of the sheet loading tray 1, and feeding the sheets P in order from a top side of the lifted sheets P, characterized in that the bottom plate 6 is lifted during an initial operation on the basis of the result of the detection of the sheets P by the second sensor 4, and during a sheet feeding operation on the basis of the result of the detection by the first sensor 3.

The sheet feeding operation is characterized by being kept carried out irrespective of the result of the detection of sheets P by the second sensor 4. Namely, even when the absence of sheets is detected by the second sensor 4, the operation for feeding the sheets P keeps being carried out as long as the sheets P are detected by the first sensor 3 during the sheet feeding operation. Owing to such operations, judging the condition in which the sheets P are present in the sheet loading tray 1 but merely floated from a lower portion thereof because of the sheet P held by the sheet separating unit 8 as a no-paper condition, and interrupting the feeding of the sheets can be prevented.

The effects of the above-mentioned technical steps will now be described.

In an initial operation in which a user stacks the sheets P correctly on the bottom plate 6 in the sheet loading tray 1 and sets the resultant sheet loading tray 1 on the image forming apparatus, the sheets P are detected by the second sensor 4, and the control unit 5 in the image forming apparatus receives an output from the sensor 4 and recognizes that the sheets P exist on the sheet loading tray 1. The control unit 5 operates on the basis of this recognition the bottom plate lifting mechanism 7 to lift the bottom plate 6 and display such recognized information on a display, such as a control panel provided in the image forming apparatus.

When a sensor (not shown) recognizes that the bottom plate 6 moves up to a position in which the uppermost surface of the stacked sheets P comes into contact at a predetermined pressure with the sheet nudging member 2, a driving power source (not shown) receives a sheet feeding signal from the control unit 5 and drives the sheet nudging member 2 and sheet separating unit provided on the downstream side thereof, the sheets P stacked in the sheet loading tray 1 being taken up from the upper side thereof by the sheet nudging member 2 and sent out. The resultant sheets P are separated one by one by the sheet separating unit 8, and transferred in order toward an image forming unit provided on the downstream side thereof.

These predetermined number of sheets are transferred to the image forming unit, the uppermost surface of the sheets in the tray lowers, so that a contact pressure of the sheets P against the sheet nudging member 2 gradually decreases. Consequently, the transferring of the stacked sheets P becomes difficult if the mentioned contact pressure is left decreasing. Therefore, when the lowering of the upper surface of the sheets is recognized by a sensor (not shown) with the presence of the sheets P recognized by the first sensor 3, the bottom plate 6 moves up by an operation of the bottom plate lifting mechanism 7 to cause the upper surface of the sheets to be brought into contact at a predetermined pressure with the sheet nudging member 2, whereby the transfer of the sheets P is rendered possible.

When the sheets P are stacked by, for example, a user in an initial operation on a downstream side portion of the interior of the sheet loading tray 1, i.e., on such a rear portion thereof that does not permit the sheets to be transferred by the nudging member 2, a no-sheet condition is recognized by the second sensor 4, and the control unit 5 does not operate the bottom plate lifting mechanism 7 with "NO SHEET" indicated on a display (not shown). The second sensor 4 is disposed in a position close to the sheet nudging member 2 or on the downstream side thereof, and capable of preventing the destruction, which is ascribed to a wild upward movement of the bottom plate 6, of a sheet transfer mechanism including the sheet nudging member 2.

Even in a case where multiple sheets P are on standby in a held condition at, for example, the sheet separating unit 8 in the midst of a sheet transfer operation, the second sensor 4 detects the condition as "NO SHEET" condition. In this case, the sheets P still remain, and it is not preferable to carry out a no-sheet-time operation. Therefore, in the midst of a sheet transfer operation, the control unit 5 carries out a no-sheet-time operation by not using the no-sheet information obtained by the second sensor 4 but using the information from the first sensor 3 which detects the presence or absence of sheets from a position above the sheets P.

BRIEF DESCRIPTION OF THE DRAWINGS

Preferred embodiment of the present invention will be described in detail on the basis of the following figures, wherein.

DESCRIPTION OF THE PREFERRED EMBODIMENT

The present invention will now be described in detail on the basis of the embodiment shown in the attached drawings.

Figure 1:
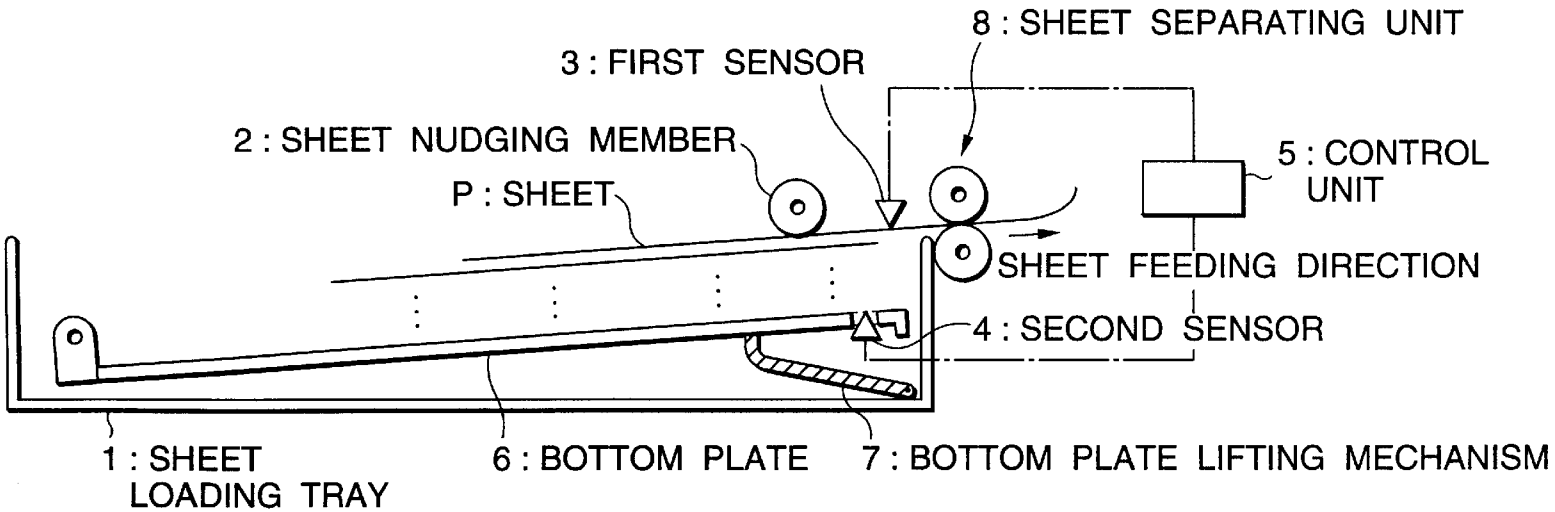
FIG. 1 is an explanatory view schematically showing an apparatus according to the present invention.
Figure 2:
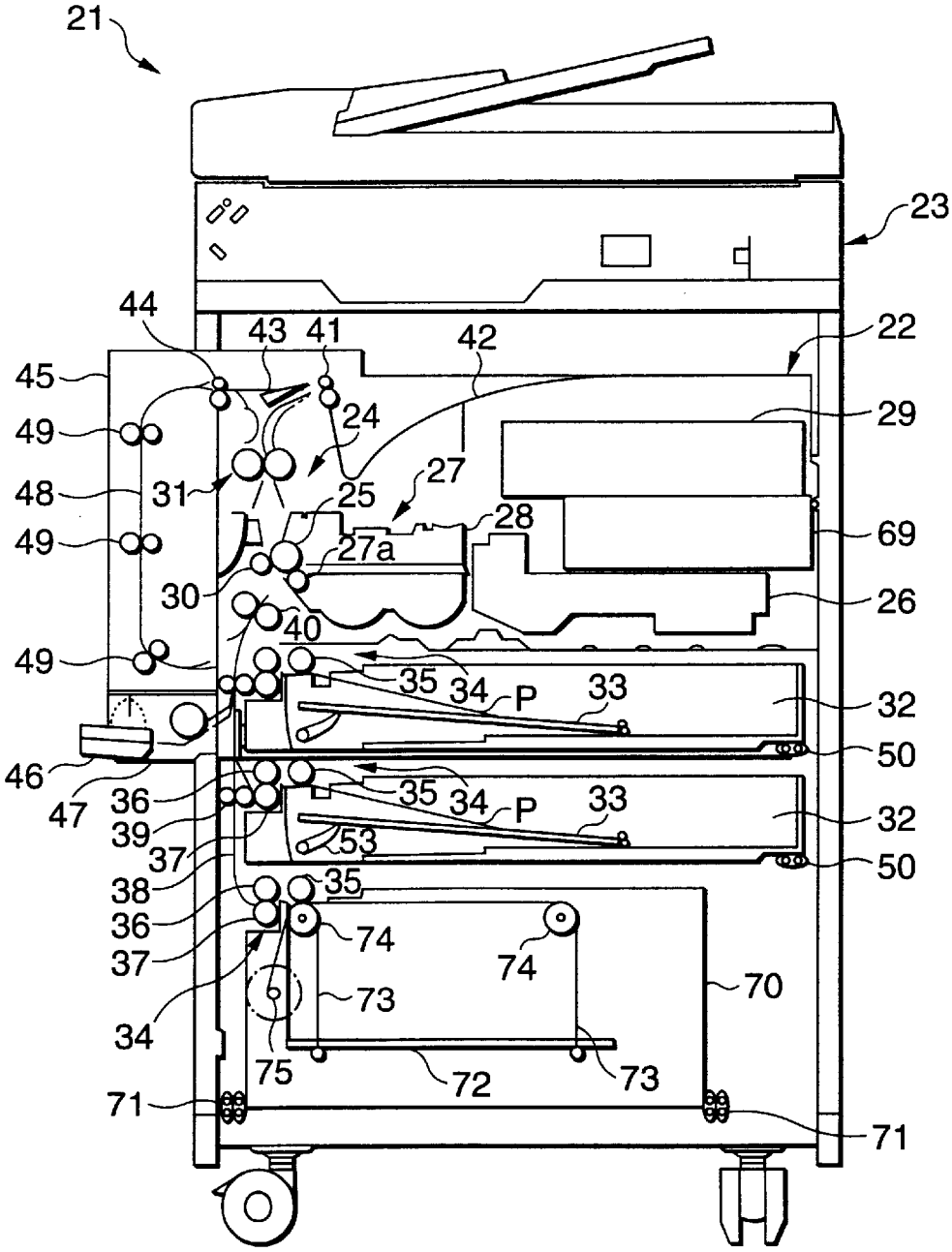
FIG. 2 is an explanatory view schematically showing an image forming apparatus of an embodiment.

FIG. 2 schematically shows the image forming apparatus of the embodiment to which the present invention is applied.

An image forming apparatus 21 is provided with an apparatus body 22 adapted to form images on sheets (paper) P, and an image reading unit (IIT) 23 adapted to read an image on an original.

This apparatus body 22 has an image forming section 24 for forming an image directly on a sheet P. Referring to the drawing, a reference numeral 25 denotes a photosensitive drum, 26 a laser exposure unit for forming an electrostatic latent image on the photosensitive drum 25 on the basis of a signal outputted from an image processing unit (IPS) 29, 27 a developing unit for turning an electrostatic latent image formed on the photosensitive drum 25 into a visible image with a developer, such as a toner, 30 a transfer unit for transferring an unfixed toner image onto the sheet P by a transfer roll opposed to the photosensitive drum 25, and 31 a fixing unit for fixing the unfixed toner image formed on the sheet P by the transfer unit 30, the fixing of the toner image being done by bringing a heating roll and a pressure roll into contact with each other under a suitable pressure, and passing the sheet P between these rolls. In this embodiment, the photosensitive drum 25 and developing unit 27 are incorporated together in a cartridge 28 capable of being set in and removed from the apparatus body 22, and the cartridge 28 serves also as a tank for holding the developer, which is fed onto the photosensitive drum 25 via a developing roll 27*a*. The image processing unit (IPS) 29 carries out as an electronic copier the conversion of image information outputted from the IIT 23, and as a printer or a facsimile transfer unit the conversion of image information outputted from an external apparatus, into image information capable of being formed in the apparatus body 22. A control unit 69 is adapted to control a movement of each structural element of the apparatus body 22, receive signals from sensors provided in various portions of the apparatus body 22, and transfer the sheet P by controlling an actuator.

The apparatus body 22 is provided therein with plural (two in this embodiment) sheet feeding trays 32, which hold sheets P of different sizes or to be fed in different directions, detachably and in a vertically spaced manner. These sheet feeding trays 32 hold multiple sheets P stacked on bottom plates 33 provided therein, and are formed so that they can be inserted from a front side (front surface of FIG. 2) of the apparatus body 22 thereinto and withdrawn therefrom via rails 50. When the insertion of a sheet feeding tray 32 into the apparatus body 22 is detected by a tray sensor (not shown), the bottom plate 33 therein moves up and an upper side of the sheets P contacts a nudger roll 35 which will be described later. After the upper sheet P lifts up the nudger roll 35, the upward movement of the bottom plate 33 stops.

In the lowermost portion of this apparatus body 22, a large-capacity sheet feeding tray (HCF) 70 is provided. The large-capacity sheet feeding tray 70 is supported on a pair of rails 71, and formed so that it can be withdrawn from and set in the apparatus body 22. These withdrawing and setting actions are detected by a tray sensor (not shown). The large-capacity sheet feeding tray 70 is provided therein with a bottom plate (lift table) 72 loaded with sheets P and capable of being vertically moved. The bottom plate 72 is lifted by a wire, which is wound around a hoisting shaft 75, via a pulley 74. The hoisting shaft 75 is rotated by a lift-up motor (not shown), and a brake (not shown) is connected thereto. When the large-capacity sheet feeding tray 70 is set in the apparatus body 22, the lift-up motor receives a signal from the control unit 69 and rotates the hoisting shaft 75 to take up the wire 73 and move up the bottom plate 72. When the large-capacity sheet feeding tray 70 is withdrawn, the lift-up motor and hoisting shaft 75 are disengaged from each other, and the bottom plate 72 naturally falls but not at a stroke owing to an operation of the brake.

The apparatus body 22 is also provided therein with sheet feeding rolls 34, which are adapted to send out the stacked sheets P one by one from the upper side thereof toward the image forming section 24, for each sheet feeding trays 32 and large-capacity sheet feeding tray 70. In this embodiment, sheet feeding rolls 34 common to each sheet feeding trays 32 and large-capacity sheet feeding tray 70 are used so as to reduce the equipment cost. These sheet feeding rolls 34 have nudger rolls 35 adapted to contact upper sides of the stacked sheets P and nudge the same sheets P lifted by upward movements, which are made by lift levers 53 for the sheet feeding trays 32, of the bottom plates 33 therein, and by an upward movement of the bottom plate 72 in the large-capacity sheet feeding tray 70, as well as feed rolls 36 and retard rolls 37, which are paired and constitute sheet separating units adapted to separate sheets P taken out from the nudger rolls 35.

On the portion of a left inner surface of the apparatus body 22 which is on the downstream side of the feed rolls 36 and retard rolls 37, a sheet transfer passage 38 is formed, which has plural transport rolls 39 provided therein. A sheet P fed from the large-capacity sheet feeding tray 70 in the lowermost position is transferred along the whole of the sheet transfer passage 38, and sheets P fed from the sheet feeding trays 32 in upper positions meet the above sheet P at an intermediate portion of the sheet transfer passage 38, all the sheets P being transferred toward the image forming section 24. On the upstream side of the image forming section 24, registration rolls 40 are provided at which the postures and timing of the transfer of the sheets P are set identical, and the resultant sheets P are sent to the image forming section 24 on the basis of an instruction from the control unit 69.

The sheet P passed through the fixing unit 31 via the image forming section 24 and having an image formed on a first surface thereof is discharged when it is subjected to one-side printing onto a sheet discharge tray 42, which is formed on an upper surface of the apparatus body 22, by a first sheet discharge roll 41 with the image-carrying first surface directed downward.

When the sheet P is subjected to two-side printing, it is once sent to the sheet discharge tray 42. When a rear end portion of the sheet P reaches a position in which it is held by the first sheet discharge roll 41, a gate 43 is switched in accordance with an instruction from the control unit 69, and the first sheet discharge roll 41 is reversely rotated to reverse the sheet P, i.e., turn the rear end portion of the sheet P into a new front end portion thereof, the resultant sheet P being sent from a second sheet discharge roll 44 to an automatic duplex unit 45.

This automatic duplex unit 45 has an outer shell formed of a comparatively thin casing the depth of which is slightly smaller than that of the apparatus body 22, and, on the lower side of the automatic duplex unit, a support unit 47 for a manually inserting tray 46 is fixed to the apparatus body 22. The automatic duplex unit 45 is hinged at its lower end portion to the support unit 47 with an upper side of the former forming a free end capable of being opened and closed with respect to the apparatus body 22. The automatic duplex unit 45 is provided therein with a circulating transfer passage 48 for two-side printing, in which plural transfer rolls 49 are arranged. This circulating transfer passage 48 is joined to the sheet transfer passage in the apparatus body 22, and opposed at one end opening thereof to the sheet discharge roll 44, and at the other end opening thereof to an upper end portion of the sheet transfer passage 38.

During a two-side printing operation, the sheet P printed at its first (front) surface is sent from the second sheet discharge roll 44 into the circulating transfer passage 48, and then downward by transfer rolls 49, the resultant sheet P being fed to the sheet transfer passage 38 in the apparatus body 22 again. The timing of the transfer of the sheet P is then set by the registration roll 40, and an image is formed on a second (rear) surface of the sheet P in the image forming section 24. The second surface is thereafter fixed through the fixing unit 31, and the sheet P is discharged onto the sheet discharge tray 42 with the second surface thereof directed downward.

The sheet feeding tray 32 will now be described in detail with reference to FIG. 3.

Figure 3:
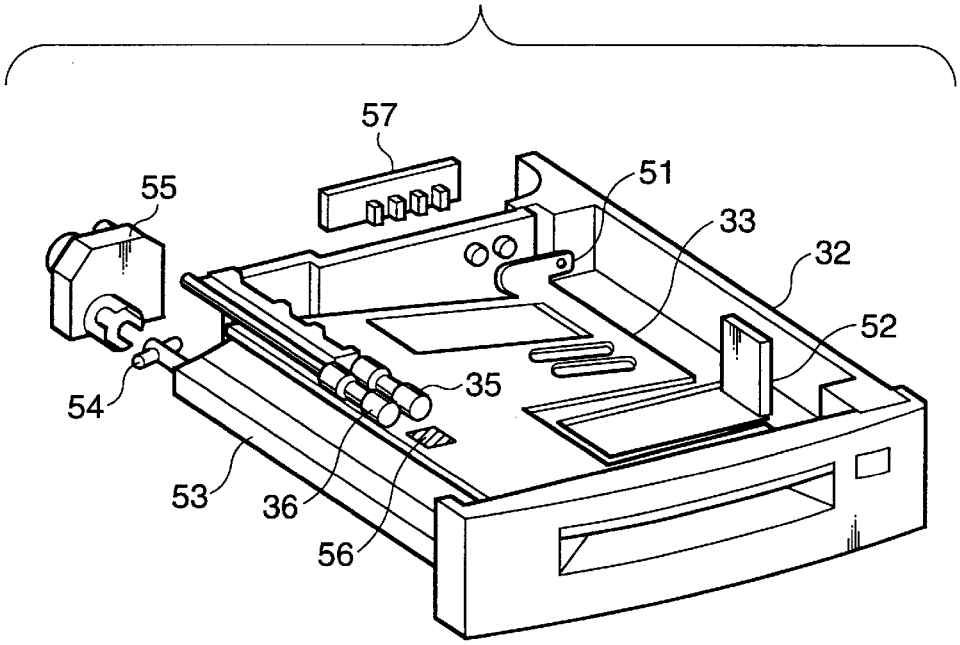
FIG. 3 is a perspective view for describing a sheet feeding tray in the embodiment.

FIG. 3 shows the sheet feeding tray 32 in perspective. The bottom plate 33 of the sheet feeding tray 32 is formed so that sheets P can be stacked thereon, and it is provided with hinge mechanisms 51 at the portion thereof which is in the vicinity of an end portion thereof on the opposite side of a sheet feed starting end portion thereof. The hinge mechanisms 51 are attached to both of inner side surfaces of the sheet feeding tray 32 so that the sheet feed starting end portion of the bottom plate 33 can be turned. The sheet feed starting end portion of the bottom plate 33 is moved up by an operation of a lift lever 53 via a joint 54 by the rotation of a lift-up motor 55 to cause the end portion of the sheet P which corresponds to the sheet feed starting end portion of the bottom plate to engage a lower portion of a circumferential surface of the nudger roll 35. A bottom surface of the sheet feeding tray 32 is provided thereon with an end guide 52 adapted to position rear ends (upstream ends with respect to the sheet transfer direction) of the stacked sheets P by pressing the sheets P at the mentioned ends thereof. The end guide 52 is formed so that it can be moved in the sheet transfer direction, and changed in the position thereof depending upon the size of the sheets P.

In this embodiment, a no-paper sensor 56 is provided on the bottom plate 33. The no-paper sensor 56 is positioned between the nudger roll 35 and feed roll 36 with respect to the sheet transfer direction, and formed of, for example, a reflection type sensor for detecting the existence of the sheets P from the lower side thereof. The no-paper sensor 56 is adapted to ascertain that the sheets P are stacked and positioned with at least the front ends thereof in a position on the downstream side in the sheet transfer direction of that (in the same transfer direction) of the nudger roll 35.

The apparatus body 22 is further provided therein with a size sensor 57 adapted to detect the size of the sheets P and the direction in which the sheets P are held in each sheet feeding tray. The size sensor 57 detects the size of the sheets P lifted by bottom plate 33, and outputs the result to the control unit 69, which outputs and displays the size information for a user of the apparatus by using, for example, a control panel (not shown).

Figure 4:
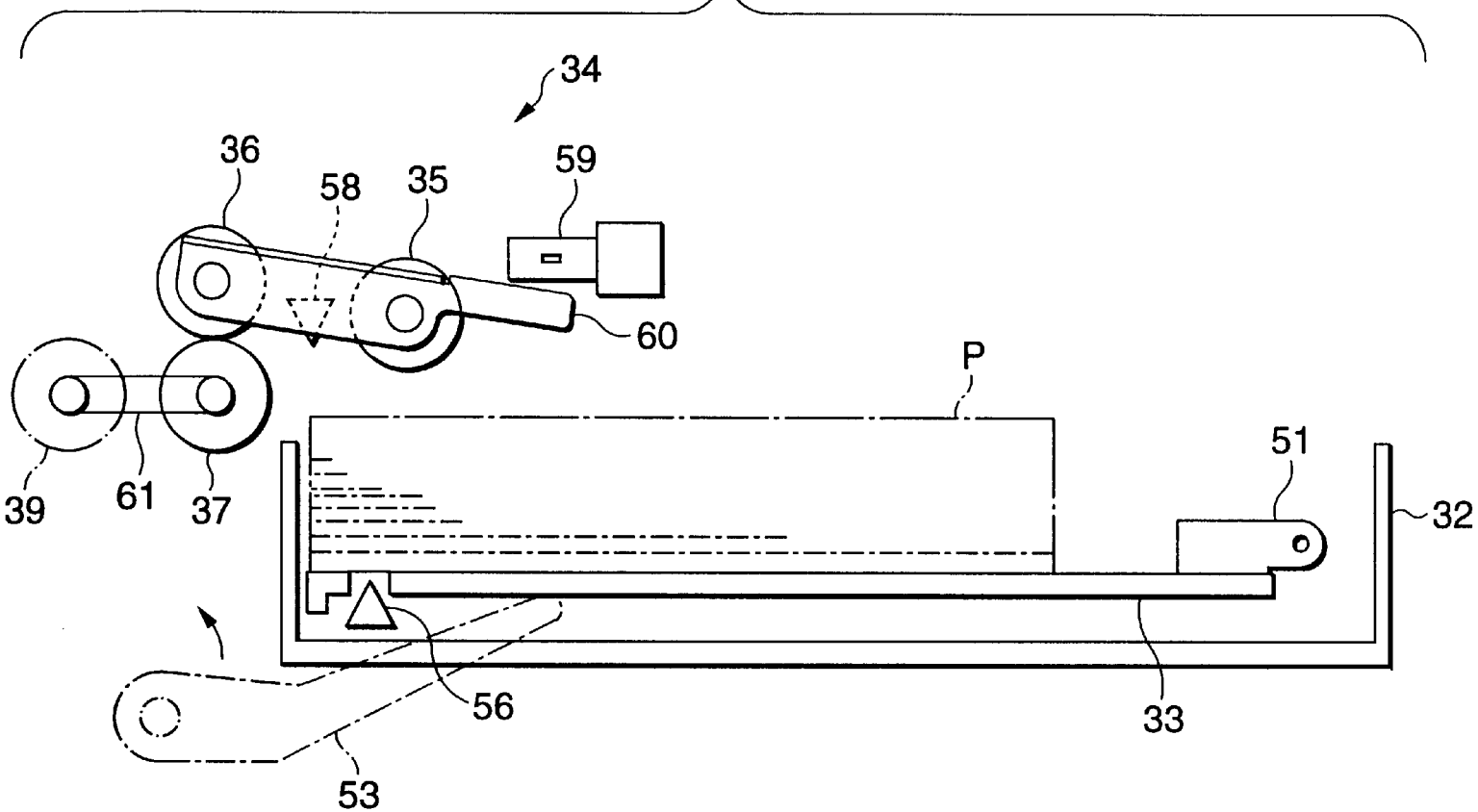
FIG. 4 is an explanatory view showing the construction of the sheet feeding tray and sheet feed rolls in the embodiment.

FIG. 4 is an explanatory view showing the construction of each of the sheet feeding tray 32 and sheet feeding rolls 34. As mentioned above, the no-paper sensor 56 provided on the bottom plate 33 detects the presence or absence of the stacked sheets P from the lower side thereof. In the sheet feeding rolls 34 provided above the sheet feeding tray 32, the nudger roll 35, feed roll 36 and retard roll 37 are formed of rolls of the same shape and size to outer surfaces of both of axial end portions of which an elastic material, such as rubber is applied to form diameter-increased portions the diameter of which is slightly larger than that of intermediate portions thereof. These diameter-increased portions contact a sheet P and execute an operation for transferring the same. The nudger roll 35 is supported in a cantilevered state on an arm 60 adapted to be turned around a shaft of the feed roll 36. The feed roll 36 is adapted to receive power from a feed motor (not shown) via a driving gear (not shown) and a feed clutch (not shown), and be rotated when the feed clutch is engaged, via a feed roll shaft in a forward direction in which a sheet P is fed by the feed roll. The nudger roll 35 has on its shaft a gear (not shown) fixedly mounted thereon, and is formed so as to be rotated with the feed roll 36 via this gear. During this time, the nudger roll 35 is turned in accordance with the forward rotation of the shaft thereof, around the shaft of the feed roll 36 as the axis of rotation, and in the direction in which the nudger roll 35 presses an outer surface of the sheet P owing to the turning of the arm 60.

The retard roll 37 is supported so that it can be rotated freely around a shaft of the transport roll 39 as an axis of rotation via a supporter 61, the retard roll being formed so that the pressure thereof increases as the feed roll 36 rotates. A shaft of the retard roll 37 is provided with a torque limiter (not shown) thereon. When the sheets Pare absent, a frictional force$\mu$ of the retard roll 37 is large, and overcomes a limiting force of the torque limiter, so that the retard roll 37 is turned with the feed roll 36. When not smaller than two sheets P are transferred at once, a frictional force therebetween is small, so that the retard roll 37 is turned by the torque limiter in the direction opposite to the sheet feeding direction. As a result, the feed roll 36 and retard roll 37 stop the sheets P including a second sheet onward transferred in a superposed state. Finally, the retard roll works to separate these sheets P from each other and send them one by one toward the downstream side.

Above the sheet feeding tray 32, a face control sensor 59 for detecting the position of an upper side of the sheets P is provided. The face control sensor 59 has a C-shaped structure so that an end portion of the arm 60 can pass therethrough. The bottom plate 33 is moved up by an operation of the lift lever 53 to cause a transfer starting end portions of the sheets P to be lifted, so that the upper side of the sheets P raises the nudger roll 35. When an end portion of the arm 60 passes at this time through the face control sensor 59, the arrival of the sheets P at a proper upper position is detected by the face control sensor 59. Namely, the height of the sheets P is detected by turning on and off the face control sensor 59 in accordance with upward and downward movements of the nudger roll 35. Above the sheet feeding tray 32, an upper no-paper sensor 58 is further provided, which detects the presence and absence of sheets in the midst of a sheet transfer operation.

Figure 5:
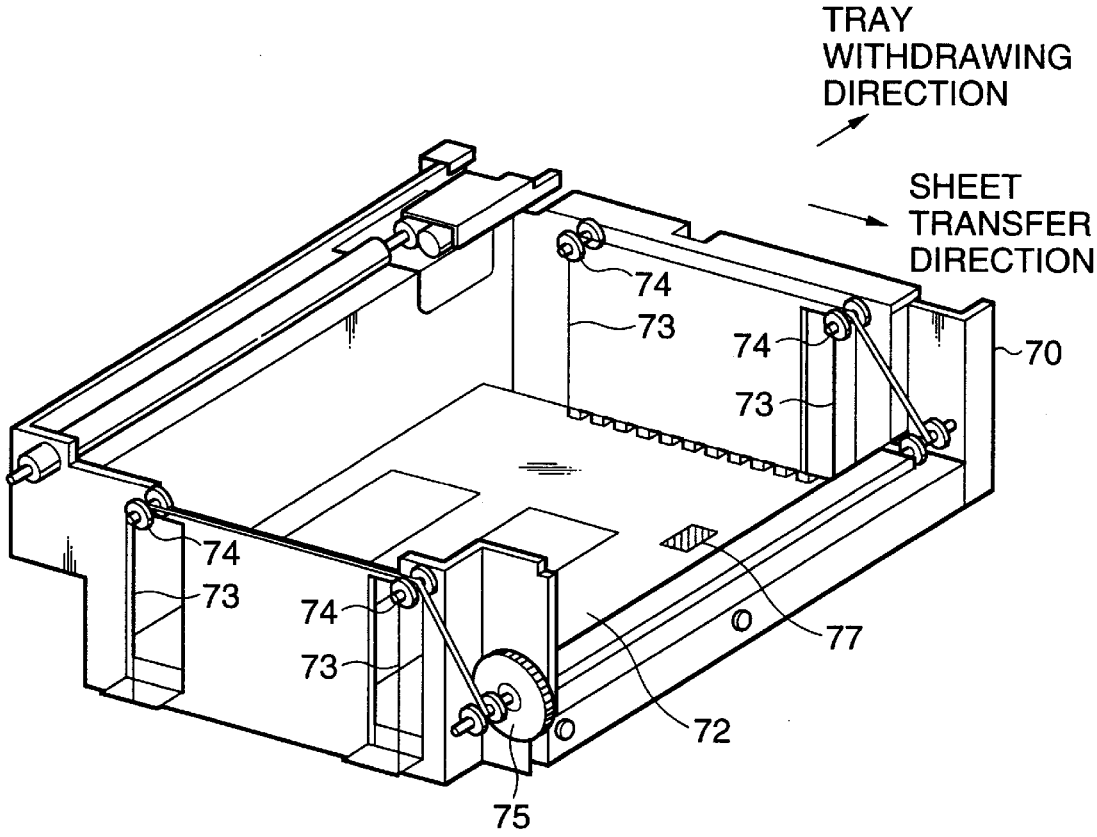
FIG. 5 is a perspective view for describing a large capacity sheet feeding tray in the embodiment.

FIG. 5 is a perspective view showing the large capacity sheet feeding tray 70 seen from a rear side (opposite to the side from which the tray is withdrawn) of the apparatus. As previously mentioned, the bottom plate 72 of the large capacity sheet feeding tray 70 is lifted by the hoisting shaft 75 via the wire 73 and pulley 74, and thereby enables the sheets P to be fed, this tray being designed so that 3300 sheets of regular paper can be held therein. The bottom plate 72 on which the sheets P are stacked is provided on the portion thereof which is in the vicinity of a sheet transfer starting end portion thereof with a no-paper sensor 77, the position of which is set so that it is between a nudger roll 35 and a feed roll 36 provided above the large capacity sheet feeding tray 70. When the result of detection is outputted from the no-paper sensor 77, the hoisting shaft 75 is rotated by a lift-up motor (not shown) to take up the wire 73 and lift up the bottom plate 2.

Above the large capacity sheet feeding tray 70, mechanisms similar to the sheet feeding rolls 34 shown in FIG. 4 are also provided, though they are not shown in FIG. 5. A face control sensor 59 for detecting an upper side of the sheets P in accordance with the upward and downward movements of the nudge roll 35, and an upper no-paper sensor 58 for detecting the presence and absence of the sheets P in the midst of a sheet feeding operation.

An operation for feeding the sheets P in this embodiment of the present invention will now be described with reference to FIGS. 3 to 5.

For example, when "NO PAPER" is displayed on a control panel (not shown), a user withdraws the sheet feeding tray 32 from the apparatus body 22, and carries out an operation for stacking sheets P on the bottom plate 33 of the sheet feeding tray 32. If during this time the user stacks the sheets P in a downstream side position with respect to the sheet transfer direction on the bottom plate 33 without properly using the end guide 52 with the sheet feeding tray 32 thereafter set as it is in the apparatus body 22, the no-paper sensor 56 becomes incapable of detecting the sheets P. If the bottom plate 33 in this condition is lifted up as it is, the sheet P does not contact the lower portion of the circumferential surface of the nudger roll 35 but keeps moving up to run wildly. The lifting of the nudger roll 35 by the upper side of the sheets P enables the face control sensor 59 to detect the position of the upper side of the sheets P. However, when the sheets P do not contact the nudger roll 35, the control unit 69 in the apparatus body 22 cannot recognize the existence of the sheets P, and the lift-up motor 55 continues to be rotated as it is. Consequently, the bottom plate 33 keeps moving up, and, finally, various kinds of structural parts, such as the face control sensor 59 and arm 60 are destroyed.

Therefore, this embodiment is formed so that, when the no-paper sensor 56 cannot detect the sheets P in the sheet feeding tray 32 just set in the apparatus body 22, the upward movement of the bottom plate 33 is prohibited with "NO PAPER" continues to be indicated on the control panel by the control unit 69 irrespective of whether the sheets P have been stacked by the user or not. Namely, a re-ascertaining operation by the user is promoted, and a subsequent sheet feeding operation is stopped until the sheets P have been stacked correctly and detected by the no-paper sensor 56. The position of the no-paper sensor 56 is a position in which the sheets P can press the nudger roll 35, whereby the occurrence of the above mentioned troubles can be prevented.

The sheets thus correctly set are drawn from the upper side thereof, and separated one by one by the feed roll 36 and retard roll 37 which constitute a sheet separating unit, the resultant sheets being transferred to the downstream side. When a predetermined number of sheets are thereafter transferred, the nuder roll 35 falls, and a pressure required to lift the sheets P becomes unable to be obtained. The face control sensor 59 recognizes this condition owing to a downward movement of the arm 60, and the control unit 69 drives the lift-up motor 55 to move up the bottom plate 33 by the lift lever 53. When the sheets P run out after such actions are made repeatedly, the upper no-paper sensor 58 detects the absence of sheets, and outputs a signal to the control unit 69. The control unit 69 receives the detected information, and displays "NO PAPER" on the control panel. When a sheet feeding tray of the same size set in the same direction exists, the control unit executes an operation for changing the sheet feeding tray in which the sheets run out to the mentioned sheet feeding tray so that the sheet feeding operation in the midst of the job can be carried out continuously and smoothly.

In this embodiment, the judgement of the presence or absence of sheets P in the midst of the transfer of the sheets P or after the completion of the transfer of a predetermined number of sheets P is given on the basis of the information from the upper no-paper sensor 58, and the information from the no-paper sensor 56 provided on the bottom plate 33 is not used. The reason resides in that, when plural sheets P lifted by the nudger roll 35 and held by the feed roll 36 and retard roll 37 are on standby, the remaining sheets P are in a floating state with respect to the bottom plate 33 in spite of already printing output of plural sheets P possibility, the no-paper sensor 56 therefore outputting a signal representative of a no-paper state by mistake. The phenomena of plural sheets lifted collectively occur frequently, especially, when the number of sheets P decreases. Displaying "NO PAPER" in such a condition is not preferable for a user. In this embodiment, the no-paper condition is thus detected and outputted by using different sensors during an initial operation and in the midst of a sheet transfer operation, so that proper detection outputs can be obtained in accordance with the operational condition of the apparatus.

The sheets P stacked in the large capacity tray 70 are also controlled in the same manner. The large capacity tray 70 in this embodiment is not provided with an end guide on the downstream side portion thereof in the sheet transfer direction so as to improve the user's controllability at the sheet setting time. Therefore, there is a high possibility that a position in which the sheets P are stacked by the user shifts rearward greatly in the sheet transfer direction. As a result, the bottom plate 72 necessarily moves up with the sheets in a rearwardly shifted state, so that the destruction of various kinds of structural parts becomes liable to occur. Therefore, when the sheets P are not detected in the large capacity sheet feeding tray 70 in this embodiment just as in a control operation for the above-mentioned sheet feeding tray 32, by the no-paper sensor 77 when the user sets (inserts) the large capacity sheet feeding tray 70 in the apparatus body 22, an upward movement of the bottom plate 72 is prohibited. In the midst of a sheet transfer operation, the presence and absence of the sheets P is judged on the basis of the information from the upper no-paper sensor 58, and the information from the no-paper sensor 77 provided on the bottom plate 72 is not used. Thus, different no-paper detecting devices are selectively used in an initial operational condition and in the midst of a sheet transfer operation.

According to this embodiment, in which the no-paper sensors 56, 77 provided on the bottom plates 33, 72, and the upper no-paper sensor 58 provided above the sheet feeding tray are thus used, the wild running of the bottom plates 33, 72 ascribed to the erroneous setting of the sheets P can be prevented by the no-paper sensor 56, 77, and an erroneous detection of a no-paper condition in a case where the sheets P decrease in the midst of a sheet transfer operation, i.e., in a case where a sheet P twines round the feed roll can be prevented by the upper no-paper sensor 58.

According to the present invention described above, the presence or absence of sheets in a sheet loading tray can be recognized in accordance with the operational condition of the apparatus.

What is claimed is:

1. A sheet feeding apparatus comprising:

a sheet loading tray in which sheets are stacked;

a sheet nudging member that feeds an uppermost sheet from among the sheets stacked in the sheet loading tray;

a first sensor that detects the sheets from a position above the sheets stacked in the sheet loading tray;

a second sensor that detects the sheets from a lower side of the sheets stacked in the sheet loading tray; and a control unit adapted to detect the absence of sheets in the sheet loading tray on the basis of an output from the second sensor during an initial operation, and on the basis of an output from the first sensor in the midst of a sheet feeding operation or after the completion of the sheet feeding operation.

2. The sheet feeding apparatus according to claim 1, wherein the sheet loading tray has a bottom plate lifting mechanism that lifts the bottom plate after the sheets are stacked thereon.

3. The sheet feeding apparatus according to claim 1, wherein the second sensor is provided on a downstream side with respect to the vicinity of the sheet nudging member in the sheet feeding direction.

4. An image forming apparatus comprising:

an image forming unit that forms an image on a sheet transferred thereto;

a sheet loading tray having a bottom plate which is loaded with sheets to be transferred to the image forming unit, and which is adapted to be vertically moved;

a sheet nudging member that feeds an uppermost sheet from among the sheets stacked on the bottom plate toward the image forming unit;

a first sensor provided above the sheet loading tray to detect the sheets in the sheet loading tray, a second sensor provided on the bottom plate of the sheet loading tray to detect the sheets in the sheet loading tray; and a control unit that controls the vertical movements of the bottom plate of the sheet loading tray, wherein the control unit is adapted to prohibit an upward movement of the bottom plate when the sheets are not detected by the second sensor at the time of setting the sheet loading tray in the apparatus.

5. The image forming apparatus according to claim 4, wherein the control unit is adapted to prohibit an upward movement of the bottom plate in a sheet feeding operation when the sheets are not detected by the first sensor during the sheet feeding operation.

6. A sheet feeding method which lifts a bottom plate in accordance with a result of detection of sheets by a first sensor provided above a sheet loading tray in which the sheets are stacked on the bottom plate and a second sensor provided in a lower portion of the sheet loading tray, and feeds the lifted sheets in order from an upper side thereof, comprising the steps of:

lifting the bottom plate during an initial operation on the basis of the result of the detection of the sheets by the second sensor; and lifting the bottom plate during a sheet feeding operation on the basis of the result of the detection of the sheets by the first sensor.

7. The sheet feeding method according to claim 6, wherein the sheet feeding operation continues to be carried out during the sheet feeding operation irrespective of the result of a sheet detecting operation of the second sensor.

* * * * *